US005840469A

United States Patent [19]

Bjork et al.

[11] Patent Number: 5,840,469

[45] Date of Patent: Nov. 24, 1998

[54] GALLIC ACID AS A LASER DIRECT THERMAL DEVELOPER

[75] Inventors: Jon Alfred Bjork, Cottage Grove; James Bernard Philip, Mahtomedi, both of Minn.

[73] Assignee: Imation Corp., Oakdale, Minn.

[21] Appl. No.: 855,350

[22] Filed: May 13, 1997

[51] Int. Cl.[6] ..... G03C 1/498

[52] U.S. Cl. ..... 430/350; 430/522; 430/523; 430/617; 430/619

[58] Field of Search ..... 430/617, 619, 430/350, 522, 523

[56] References Cited

U.S. PATENT DOCUMENTS

| | | |
|---|---|---|
| 4,985,392 | 1/1991 | Bjork . |
| 5,527,757 | 6/1996 | Uyttendaele et al. . |
| 5,527,758 | 6/1996 | Uyttendaele et al. . |
| 5,536,696 | 7/1996 | Horsten et al. . |
| 5,547,914 | 8/1996 | De Meutter et al. . |
| 5,559,075 | 9/1996 | Leenders et al. . |
| 5,578,548 | 11/1996 | Bjork et al. . |
| 5,582,953 | 12/1996 | Uyttendaele et al. . |

FOREIGN PATENT DOCUMENTS

| | | |
|---|---|---|
| 0 582 144 A1 | 2/1994 | European Pat. Off. . |
| WO 94/14618 | 7/1994 | WIPO . |
| Wo 95/07882 | 3/1995 | WIPO . |
| WO 96/10213 | 4/1996 | WIPO . |

*Primary Examiner*—Thorl Chea

[57] ABSTRACT

A thermographic element comprises a support having coated on at least one surface thereof a thermographic imaging system that contains a substantially light insensitive metal salt; a gallic acid reducing agent; and an infrared absorbing compound.

These elements provide images that have high density in the ultraviolet spectral region when exposed to infrared radiation.

16 Claims, No Drawings

GALLIC ACID AS A LASER DIRECT THERMAL DEVELOPER

TECHNICAL FIELD

The invention relates to thermographic elements that contain gallic acid as a developing agent and methods for imaging the thermographic materials using an infrared laser. The thermographic elements provide excellent image density in both the visible and ultraviolet light spectra.

BACKGROUND OF THE INVENTION

In the imaging arts, elements that can be imagewise exposed by means of light or heat are well known. Conventional silver halide photographic and photothermographic elements are the most representative elements of the class of light-sensitive materials. In both conventional photographic ("wet silver") and photothermographic ("dry silver") elements, exposure of the silver halide in the photosensitive emulsion to light produces small clusters of silver atoms ($Ag^{\circ}$). The imagewise distribution of these clusters is known in the art as a latent image. Generally, the latent image formed is not visible by ordinary means and the photosensitive emulsion must be further processed in order to produce a visible image. In both dry and wet silver systems the visible image is produced by the reduction of silver ions, which are in catalytic proximity to silver halide grains bearing the clusters of silver atoms, i.e. the latent image. This produces a black-and-white image.

Conventional photographic silver halide elements require a wet development process to render the latent image visible. The wet chemistry used in this process requires special handling and disposal considerations; for example, the process equipment is large and requires special plumbing.

In photothermographic elements the photographic silver halide is in catalytic proximity to a non-photosensitive, reducible silver source such as silver behenate so that when silver nuclei are generated by exposure of the silver halide to light, those nuclei are able to catalyze the reduction of the reducible silver source. The latent image is rendered visible by application of uniform heat across the element. Thermal devices used for developing photothermographic elements address the problems in conventional photographic elements by using a dry process. However, photothermographic elements developed using these devices may have uneven or non-uniform image density, image distortions, and/or surface abrasion defects. Non-uniform image density defects may occur during the development process due to, for instance, surface variations on the heated member, the presence of foreign matter on the photothermographic element or the heated member, and insufficient allowance for outgassing of volatile materials generated during development. Image distortions can occur due to uncontrolled dimensional changes in the base of the photothermographic element during heating and/or cooling of the photothermographic element. Surface abrasions or marring can occur by dragging the photothermographic element across a stationary component in the heating device.

Thermal printing has been used successfully in making copies and transparencies. In thermal printing, when the thermographic media is exposed to heat the heated areas turn black. Long exposure times result in high image densities. Generally, in silver thermographic media shortening of the exposure time has tended to result in a decrease in image density in both the visible and ultraviolet regions. The development of heat sources that provide intense heat over a short period of exposure has caused a need for developing agents that provide high density images after a very brief exposure to heat. In U.S. Pat. No. 5,578,548 a thermographic system is described that uses a thermal printhead as the heat source. The media is placed in intimate contact with the heating elements that are then electrically energized for a period of milliseconds. The media is then advanced for imaging of the next line. The preferred developing agent in this system is methyl gallate.

European Patent No. 692,733 describes a thermographic imaging system that primarily makes use of "dot-wise" heating, especially thermal print heads. The thermal developing agents described are benzoic acid compounds that have no more than two hydroxy groups in the benzene nucleus.

In WO95/07822 is described a thermographic material that forms images on exposure to infrared laser radiation. The exposures are generally made using a total energy density greater than 500 $mJ/cm^2$. A wide variety of reducing agents are discussed as being suitable in such systems, including gallic acid and its derivatives.

The prior art has not adequately addressed the need for thermographic imaging systems that provide good image density in both the visible and ultraviolet spectral regions when the thermographic material is exposed to heat for an extremely brief period of time. Such an element will allow for faster, more efficient processing as well as sharp and sufficiently dense images.

SUMMARY OF THE INVENTION

We have discovered that thermographic materials that contain gallic acid as a thermal developer provide excellent image density in the visible and ultraviolet (UV) spectral ranges. We have also discovered that when gallic acid is used as the thermal developer less thermal energy is required to obtain a desired image density. Accordingly, the invention provides a thermographic element that contains gallic acid as the reducing agent.

The invention further provides a thermographic element comprising a support having coated on at least one surface thereof a thermographic imaging system that contains a light insensitive silver salt; a gallic acid reducing agent; and an infrared absorbing compound.

In addition, the invention provides a method of forming an image by exposing a thermographic material to infrared radiation wherein the thermographic material comprises a support having a thermographic coating on at least one surface thereof that contains a light insensitive silver salt; a gallic acid reducing agent; and an infrared radiation absorbing compound.

The thermographic materials and elements of the invention provide images of high density and quality when exposed to thermal radiation, such as that provided by an infrared laser, for an extremely brief period of time. The materials have a low $D_{min}$ in the ultraviolet range and require less thermal energy than previously known elements to provide images with a high $D_{max}$ in the ultraviolet range. In addition, the media have superior dimensional stability as they are not subjected to aqueous processing or global thermal processing. Such properties make the thermographic elements of the invention particularly useful in applications such as graphics arts films, uv masks for printed circuit board manufacture and masters for diazo duplication.

Throughout the application the terms "infrared radiation" and "infrared spectrum" are used to refer to light having a wavelength between about 750 and 1100 nm. The terms "reducing agent" and "thermal developing agent" are used interchangeably.

DETAILED DESCRIPTION OF THE PREFERRED EMBODIMENTS

The thermographic materials of the invention generally comprise a support that has a thermographic imaging system coated on at least one of its surfaces. The thermographic imaging system is made up of at least one thermographic emulsion layer that contains a light insensitive silver salt; a gallic acid reducing agent; and an infrared absorbing compound.

The light-insensitive metal salts are materials that in the presence of a reducing agent undergo reduction at elevated temperatures, e.g., about 60°–225° C., to form silver metal. Preferred salts include the silver salts of long chain aliphatic carboxylic acids such as alkanoic acids containing 4 to 30 carbon atoms, more preferably 8 to 28 carbon atoms, and, most preferably 10 to 22 carbon atoms. The latter are also known in the art as "silver soaps".

Non-limiting examples of silver salts of aliphatic carboxylic acids include silver behenate, silver stearate, silver oleate, silver erucate, silver laurate, silver caproate, silver myristate, silver palmitate, silver maleate, silver fumarate, silver tartarate, silver linoleate, silver camphorate, and mixtures thereof. Complexes of organic or inorganic silver salts wherein the ligand has a gross stability constant between 4.0 and 10.0 can also be used. Silver salts of aromatic carboxylic acids and other carboxyl group containing compounds include silver benzoate, substituted silver benzoates such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, silver phthalate, silver terephthalate, silver salicylate, silver phenylacetate, silver pyromellitate, silver salts of 3-carboxymethyl-4-methyl-4-thiazoline-2-thiones or the like as described in U.S. Pat. No. 3,785,830, and silver salts of aliphatic carboxylic acids containing a thioether group as disclosed in U.S. Pat. No. 3,330,663. Both of these patents are incorporated herein by reference.

Silver salts of compounds containing mercapto or thione groups and derivatives thereof can also be used. Preferred examples of these compounds include silver 3-mercapto-4-phenyl-1,2,4-triazolate, silver 2-mercaptobenzimidazolate, silver 2-mercapto-5-aminothiadiazolate, silver 2-(S-ethylglycolamido)benzothiazolate; silver salts of thioglycolic acids such as silver salts of S-alkyl thioglycolic acids wherein the alkyl group has from 12 to 22 carbon atoms; silver salts of dithiocarboxylic acids such as silver dithioacetate, silver thioamidoate, silver 1-methyl-2-phenyl-4-thiopyridine-5-carboxylate, silver triazinethiolate, silver 2-sulfidobenzoxazole; and silver salts as disclosed in U.S. Pat. No. 4,123,274, which is incorporated herein by reference. Furthermore, silver salts of a compound containing an amino group can be used. Examples of these compounds include silver salts of benzotriazoles, such as silver benzotriazolate; silver salts of alkyl-substituted benzotriazoles such as silver methylbenzotriazolate, etc.; silver salts of halogen-substituted benzotriazoles such as silver 5-chlorobenzotriazolate, etc.; silver salts of carboimidobenzotriazoles, etc.; silver salts of 1,2,4-triazoles and 1-H-tetrazoles as described in U.S. Pat. No. 4,220,709; silver salts of imidazoles; and the like. Preferably, the light-insensitive silver salt material is present in an amount of about 5 to 60% by weight and more preferably, from about 30 to 50% by weight, based upon the total weight of the thermographic silver emulsion layer.

Gallic acid (3,4,5-trihydroxybenzoic acid) is used as the reducing agent in the thermographic emulsion found in the thermographic element of the invention. Surprisingly, use of gallic acid as a reducing agent in thermographic imaging systems provides improved image density at the short exposure times found when the thermographic media is heated using an infrared laser. The shorter exposure time results in the thermographic element being exposed to a lower total amount of thermal energy. In general, the thermographic element of the invention can provide an image of superior sharpness and density when exposed to an infrared laser at a sufficient intensity and for a sufficient time to provide total energy of about 400 to 500 mJ/cm$^2$. The total energy delivered will depend on a variety of factors known to those of skill in the art, such as laser power, the size of the spot created by the laser on the imaging plane, the time of exposure, and so on. Notably, superior images can be obtained with very short exposure times, i.e. about 10 microseconds or less. Under conditions sufficient to provide total energy of about 400 to 500 mJ/cm$^2$, the thermographic element of the invention can provide a sharp image of a spot as small as 6 $\mu$m. The thermographic element of the invention, containing gallic acid as the reducing agent, generally has a $D_{min}$ in the ultraviolet range (365 to 410 nm) of less than about 0.2, preferably less than about 0.15 and a $D_{max}$ in the ultraviolet range of greater than about 3.0, preferably greater than about 3.2. The gallic acid is present in an amount of about 5 to 25 wt%, preferably about 10 to 20 wt% based on the total weight of the thermnographic silver emulsion layer.

The thermographic emulsions of the invention do not require the presence of an additional toner to produce an image having the desired image density. Therefore, a preferred thermographic material comprises a support that has a thermographic imaging system coated on at least one side of the support, the thermographic imaging system made up of at least one thermographic metal emulsion layer that contains a light insensitive metal salt, a gallic acid reducing agent, and an infrared absorbing compound, wherein the system is free or substantially free of a toner. However, a toner may be incorporated into the thermographic emulsion layer(s) if desired. Examples of toners include phthalazinone, phthalazine, barbituric acid, succinimide, and phthalimide. If used, the toner(s) should preferably be present in an amount in the range of about 0.2 to 10.0% by weight, more preferably about 1.0 to 8.0% by weight, and most preferably about 2.0 to 6.0% by weight, based upon the total weight of the thermographic silver emulsion layer.

Auxiliary reducing agents or development accelerators that are known in the art may be optionally included in the thermographic silver emulsion layer depending upon the silver source used.

The thermographic imaging elements of the present invention are not light-sensitive in the traditional sense and therefore should not contain photosensitive agents such as silver halides, photoinitiators, or photogenerated bleaching agents. Excessive amounts of these agents will result in an undesirable increase in $D_{min}$ upon light exposure.

Light stabilizers such as benzotriazole, phenylmercaptotetrazole, and other light stabilizers known in the art may be added to the thermographic silver emulsion. The preferred light stabilizer is benzotriazole. The light stabilizer should preferably be present in an amount in the range of about 0.1 to 3.0 wt% of the thermographic silver emulsion layer and more preferably, from 0.3 to 2.0 wt. %, based on the total weight of the thermographic silver emulsion.

The thermographic silver emulsion layer(s) found in the present invention also may employ a binder. Any conventional polymeric binder known to those skilled in the art can be utilized. For example, the binder may be selected from any of the well-known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are, of course, included in these definitions, examples of which, include, but are not limited to, the polyvinyl aldehydes, such as polyvinyl acetals, polyvinyl butyrals, polyvinyl formals, styrene/maleic anhydride copolymers, and vinyl copolymers. Polyvinyl acetate and polyvinyl butyral are preferred resins. Preferably, the binder should be present in an amount in the range of about 10 to 60 wt.% and more preferably about 15 to 40 wt.% based upon the total weight of the thermographic silver emulsion layer.

The thermographic material of the present invention employs an infrared absorbing compound, typically a dye or pigment that absorbs electromagnetic radiation having a wavelength in the range of between about 750–1100 nm, preferably in the range of about 750–900 nm, and most preferably in the range of about 750–870 nm. The dye should be soluble in the coating solvent, typically ketones or aromatic solvents, such as methyl ethyl ketone or toluene. The dye should also be miscible with the binder and compatible with the silver salts, activators, and developers used in the emulsion. For use in UV contact film or mask applications the optical density of the dye is preferably greater than 1.0 optical density units with a concomitant weak absorption of less than 0.2 optical density units in the UV region corresponding to the wavelength of exposure devices for which the material will be used as a mask (250–450 nm). The UV optical densities referred to herein are measured using a MacBeth Model TD504 densitometer equipped with a status 18A filter. It is also desirable, but not necessary, for the dye to have a low visible background absorption.

The infrared absorbing compound can be employed in the same layer as the light-insensitive silver salt and gallic acid reducing agent. Alternatively, the dye or pigment can be employed in the foregoing layer and in an adjacent layer, or primarily in the adjacent layer. The infrared absorbing compound may be added directly to the thermographic silver emulsion layer or indirectly by allowing the dye to migrate from an adjacent layer that contains the dye into the thermographic silver emulsion layer during the manufacturing process of the thermographic imaging element.

Suitable dyes or pigments include, but are not limited to, those of the diarylmethane, triarylmethane, polymethine, squarylium, croconate, cyanine, merocyanine, oxonol, porphyrin, phthalocyanine; indolizine, pyrylium, thiopyrylium, xanthene, acridine, thiazole, thiazine, azine, aminoketone, p-substituted aminostyryl, metal dithiolene, and colored aromatic polycyclic hydrocarbon classes.

The amount of dye or pigment present in the thermographic imaging material will be dependent upon whether it is incorporated solely into the thermographic silver emulsion layer or into an adjacent layer as well. When the dye or pigment is present solely in the thermographic silver emulsion layer, it will be present in an amount of from about 0.10–5.0 wt.% and preferably from about 0.2–3.0 wt.%, based upon the total weight of the thermographic silver emulsion layer.

When present in an adjacent layer, the dye or pigment will be present in the thermographic silver emulsion layer in an amount of from 0 to about 5.0 wt.%, preferably from 0 to about 2.5 wt.%, based on the total weight of the thermographic silver emulsion layer. In the adjacent layer containing dye and binder, the dye will be present in an amount of from about 1–25 wt.% and preferably about 4–10 wt.%, based upon the total weight of the adjacent layer.

Any suitable base or substrate material known to those skilled in the art can be used as a support in the present invention. Such materials can be opaque, translucent, or transparent. Commonly employed support materials utilized in the thermographic arts include, but are not limited to, paper; opaque or transparent polyester and polycarbonate films; and specularly light reflective metallic substrates such as silver, gold, and aluminum. As used herein, the phrase "specularly light reflecting metallic substrates" refers to metallic substrates that reflect light at a particular angle as opposed to reflecting light across a range of angles.

Optionally, a protective or anti-stick layer, positioned on top of the thermographic imaging element, may be used. Any conventional anti-stick material may be employed in the present invention. Examples of such anti-stick materials include but are not limited to waxes, silica particles, styrene-containing elastomeric block copolymers such as styrene-butadiene-styrene, styrene-isoprene-styrene, and blends thereof with such materials as cellulose acetate, cellulose acetate butyrate, cellulose acetate propionate, and poly(vinyl butyral).

Additional layers may be incorporated into the thermographic materials of the present invention such as a primer layer or anti-static layer. Furthermore, an anti-static or anti-stick layer may optionally be applied to the back of the support. Materials for such purposes are well known to those skilled in the art.

The thermographic imaging system, anti-stick, infrared or near-infrared dye absorbing, and anti-static layers employed in the present invention can be applied by any conventional method such as knife coating, roll coating, dip coating, curtain coating, hopper coating, etc. If desired, two or more layers may be coated simultaneously by the procedures described in U.S. Pat. No. 2,761,791 and British Patent No. 837,095.

The thermographic imaging materials of the present invention are imaged by exposure to infrared or near-infrared laser radiation, typically from a infrared or near-infrared laser diode. As is well known in the thermal imaging arts, infrared or near-infrared laser diodes may be advantageously arranged in an array to increase imaging speed. Lasers that can be used to provide infrared or near-infrared radiation include substantially any laser capable of generating light in the infrared and near-infrared region of the electromagnetic spectrum from about 750 to 1100 nm, including dye lasers; solid state diode lasers such as aluminum gallium arsenide diode lasers that emit in the region of 780 to 870 nm; and diode-pumped solid state lasers such as Nd:YAG, Nd:YLF, or Nd:glass.

The following non-limiting examples further illustrate the present invention.

EXAMPLES

Materials used in the following examples are available from standard commercial sources such as Aldrich Chemical Co. (Milwaukee, Wis.) unless otherwise specified.

Silver behenate homogenates may be prepared as disclosed in U.S. Pat. No. 4,210,717 or U.S. Pat. No. 3,457,075.

3,3,3',3'-Tetramethyl-1,1'-spirobisindane-5,5',6,6'-tetrol is available from Aldrich Chemical Co. (Milwaukee, Wis.) and has the following structure:

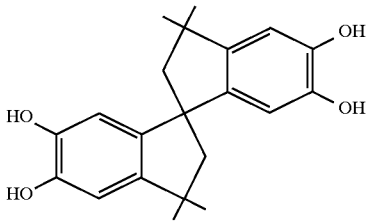

2H-1,3-Benzoxazine-2,4(3H)-dione is known as Carsalam, see U.S. Pat. No. 3,951,660, and has the following structure:

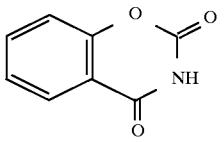

The following dyes were used in various examples which follow:

Preparation of Dye 1: In a 3 L flask, 385 g of trimethyl sulphonamido indolenine was added with 250 mL of butyronitrile. To this mixture was added, with no exotherm, 225 mL (364 g) of butyliodide followed by 750 mL of additional butyronitrile. The mixture was heated to reflux with efficient overhead stirring for 22.5 hours. The heat was removed and the mixture allowed to cool to about 40° C. Stirring was continued for 1 hour, after the addition of 1 L of ethyl acetate. The solid was filtered, washed with ethyl acetate, and dried to give 595.6 g of N-butyl-2,3,3-trimethyl-5-sulphonamido indoleninium iodide.

75 mL of cyclopentanone was added in two portions. After the first addition, a slow increase in temperature and color was observed to about 35° C., at which time the second portion was added resulting in a large exotherm. After the exotherm subsided, the mixture was heated to reflux for 4 hours. The mixture was distilled under a slight vacuum after the addition of 1 L of ethyl acetate. Approximately 250 mL of liquid was collected to which 700 mL of ethyl acetate was added when a precipitate started to form. The mixture was stirred overnight. The solid was filtered, washed with 1 L of ethyl acetate, followed by heptane, and dried under vacuum at 35° C. for 4 hours giving rise to 115.8 g of crude chlorocyclopentene dialdehyde.

The crude chlorocyclopentene dialdehyde was dissolved in 1250 mL of water. Crystals started to appear after about 1 hour. The mixture was allowed to stand over the weekend. The brownish solid was filtered, washed with water, and dried under vacuum at 35° C. for 7 hours giving rise to 61.0 g of chlorocyclopentene dialdehyde.

To a solution of 450 mL of acetic acid and 450 mL of acetic anhydride was added 278.7 g of N-butyl-2,3,3-trimethyl-5-sulphonamide indoleninium iodide and 47.6 g of cyclopentene dialdehyde. To the stirred mixture was added dropwise 90 mL of triethylamine over 5 minutes at 60°–65° C. No large exotherm was observed. The mixture was heated for an additional 30 minutes, after which the heat was removed and the reaction mixture cooled to 15° C. The resultant golden-brown solid was filtered and washed with a 1:1 mixture of acetic acid:acetic anhydride until the washings were greenish rather than purple. Residual acetic acid and acetic anhydride were removed by suspending the solid in 1 L of ethyl acetate, followed by stirring for 90 minutes. The solid was filtered and washed with ethyl acetate. The filtrate had a pink hue. The solid was dried at 45° C. under vacuum overnight, yielding 250.0 g of Dye 1.

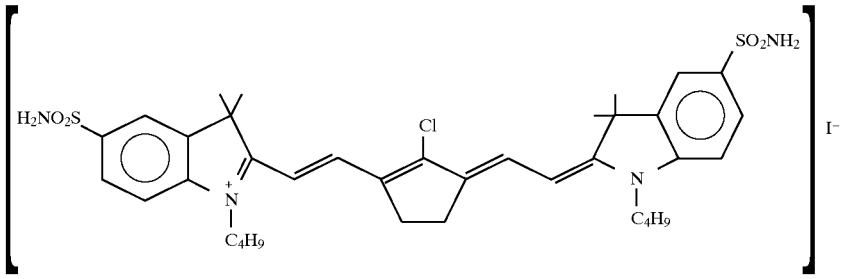

Over one hour, 277 ml of phosphorous oxychloride was added to a solution of 370 mL of methylene chloride and 558 mL of dimethylformamide, cooled to below 5° C. at a rate such that the temperature did not exceed 5° C. After completion of the addition, the external cooling was removed and the mixture was stirred for 1 hour. Over a 30 minute period, Preparation of Dye 2: A mixture of 0.1 moles of Dye 1 prepared above, 0.1 moles of sodium tetraphenylborate, and 500 mL of methanol was refluxed with stirring for 10 minutes. The solid was filtered, washed with methanol, followed by water, and then dried to give 0.97 moles of Dye 2.

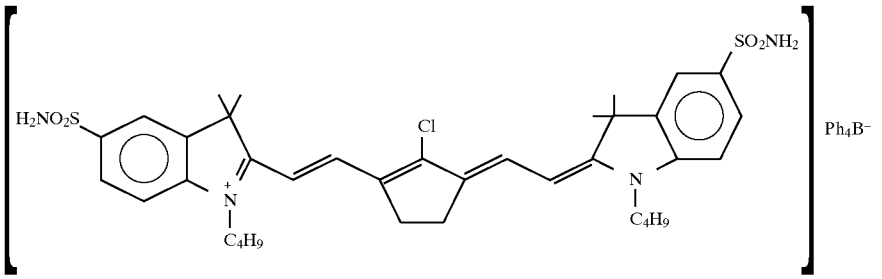

EXAMPLE 1

The following coating solutions were used in the preparation of Example 1:

Silver Emulsion:

A silver behenate coating solution comprising the following ingredients (parts by weight) was prepared:

| | |
|---|---|
| Silver behenate | 11.96 |
| Butvar ™ B76 poly(vinyl butyral), available from Monsanto Co. | 0.50 |
| BX-1 poly(vinyl butyral), available from Sekisui Chemical Co. | 2.83 |
| Methyl ethyl ketone | 63.53 |
| Toluene | 21.18 |

Activator Solution:

An activator coating solution comprising the following ingredients (parts by weight) was prepared:

| | |
|---|---|
| Tetrachlorophthalic anhydride | 0.08 |
| Gallic Acid | 0.48 |
| Methanol | 0.10 |
| Methyl ethyl ketone | 3.08 |

Thermographic Coating Solution:

The thermographic coating solution for Example 1 was prepared by mixing 3.74 g of the activator coating solution described above with 12 g of the silver behenate coating solution described above:

The resulting solution was coated onto a 0.08 mm (3 mils) polyester substrate at a 0.05 mm (2 mils) wet thickness and air dried at 60° C. for 3 minutes.

Topcoat Coating Solution:

An infrared-absorbing topcoat coating solution comprising the following ingredients (parts by weight) was prepared:

| | |
|---|---|
| Dye 2 | 0.40 |
| Tyril ™ 1000A Styrene/acrylonitrile copolymer, available from Dow Chemical | 2.53 |
| Methyl ethyl ketone | 97.07 |

The topcoat solution was coated onto the thermographic layer at a 0.05 mm (2 mils) wet thickness and air dried for 3 minutes at 60° C. The resulting media green color.

The above sample was imaged with a CREO Laser Digital Proofer operating at 823 mn, 40 mW per channel, and a 6.4 micron dot. The drum speed was varied to deliver a calculated energy density on the film plane of 200, 250, 300, 350, 400 and 500 $cm^2$. The visible optical densities and the UV optical densities were measured using a MacBeth TD504 densitometer equipped with a status 18A filter. The data is summarized in Table 1.

TABLE 1

| Energy Density $mJ/cm^2$ | UV Density | Visible Density |
|---|---|---|
| 500 | 3.48 | 1.73 |
| 400 | 2.81 | 1.54 |
| 350 | 2.69 | 1.53 |
| 300 | 1.71 | 0.91 |
| 250 | 1.33 | 0.70 |
| 200 | 0.90 | 0.51 |
| $D_{min}$ | 0.11 | 0.06 |

Comparative Examples 1–2

Imaging compositions were prepared as described in Example 1 except the Gallic Acid was replaced by an equal weight of the indicated reducing agent:

Comparative Example 1: Tannic Acid

Comparative Example 2: Methyl Gallate

The samples of Comparative Examples 1–2 were imaged as described in Example 1 and the resulting densities were measured as described in Example 1. The results are summarized in Tables 2–3.

TABLE 2

| | UV Densities | |
|---|---|---|
| Energy Density $mJ/cm^2$ | Comparative Example 1 | Comparative Example 2 |
| 500 | 2.17 | 3.13 |
| 400 | 1.50 | 2.48 |
| 350 | 1.52 | 2.55 |
| 300 | 0.84 | 1.54 |
| 250 | 0.57 | 1.17 |
| 200 | 0.27 | 0.67 |
| $D_{min}$ | 0.11 | 0.11 |

TABLE 3

| | Visible Densities | |
|---|---|---|
| Energy Density $mJ/cm^2$ | Comparative Example 1 | Comparative Example 2 |
| 500 | 0.87 | 1.13 |
| 400 | 0.59 | 0.94 |
| 350 | 0.61 | 0.87 |
| 300 | 0.35 | 0.49 |
| 250 | 0.29 | 0.35 |
| 200 | 0.14 | 0.24 |
| $D_{min}$ | 0.05 | 0.06 |

Comparative Examples 3–7

The following coating solutions were used in the preparation of Comparative Examples 3–7:

Activator Solution:

Activator coating solutions were prepared for Comparative Examples 4–8 by mixing the indicated weight in grams of each ingredient shown in Table 4:

TABLE 4

| INGREDIENTS | Comp. Ex. 3 | Comp. Ex. 4 | Comp. Ex. 5 | Comp. Ex. 6 | Comp. Ex. 7 |
|---|---|---|---|---|---|
| Tetrachlorophthalic anhydride | 0.064 | 0.064 | 0.064 | 0.064 | 0.064 |
| 3,3,3',3'-Tetramethyl-1,1'-spirobisindane-5,5',6,6'-tetrol | 0.38 | 0.38 | 0.38 | — | — |
| 3,4-Dihydroxybenzoic acid | — | — | — | 0.38 | — |
| 3,4-Dihydroxybenzaldehyde | — | — | — | — | 0.38 |
| Carsalam | — | 0.08 | 0.16 | — | — |
| Methyl ethyl ketone | 2.60 | 2.60 | 2.60 | 2.60 | 2.60 |
| Methanol | 0.20 | 0.20 | 0.20 | 0.20 | 0.20 |

Thermographic Coating Solution:

The thermographic coating solutions for Comparative Examples 3–7 were prepared by mixing the activator coating solutions described above with 12 g of the silver behenate coating solution described in Example 1.

The resulting solution was coated onto a 0.08 mm (3 mils) polyester substrate at a 0.05 mm (2 mils) wet thickness and air dried at 60° C. for 3 minutes to give dry coating weights of about 8 g/m$^2$ (0.75 g/ft$^2$).

Topcoat Coating Solution:

An infrared-absorbing topcoat coating solution comprising the following ingredients (parts by weight) was prepared:

| | |
|---|---|
| Dye 2 | 0.5 |
| Scripset ™ 540 Styrene/maleic anhydride copolymer, available from Monsanto Co., St. Louis, MO | 7.7 |
| Methyl ethyl ketone | 144.0 |

The topcoat solution was coated onto the thermographic layer at a 0.05 mm (2 mils) we thickness and air dried for 3 minutes at 60° C. to give a dry topcoat weight of about 1.0 g/m$^2$ (0.1 g/ft$^2$). These resulted in clear thermally sensitive media with a slight green tint.

The above samples were imaged and the resulting densities measured as described in Example 1. The data are summarized in Tables 5 and 6.

TABLE 5

| | UV Densities | | | | |
|---|---|---|---|---|---|
| Energy Density mJ/cm$^2$ | Comp. Ex. 3 | Comp. Ex. 4 | Comp. Ex. 5 | Comp. Ex. 6 | Comp. Ex. 7 |
| 500 | 2.68 | 2.66 | 2.64 | 2.03 | 1.95 |
| 400 | 1.89 | 1.92 | 1.91 | 1.44 | 1.30 |
| 350 | 1.50 | 1.55 | 1.53 | 1.07 | 0.98 |
| 300 | 1.05 | 1.14 | 1.18 | 0.68 | 0.62 |
| 250 | 0.43 | 0.35 | 0.43 | 0.29 | 0.37 |
| $D_{min}$ | 0.11 | 0.12 | 0.11 | 0.10 | 0.21 |

TABLE 6

| | Visible Densities | | | | |
|---|---|---|---|---|---|
| Energy Density mJ/cm$^2$ | Comp. Ex. 3 | Comp. Ex. 4 | Comp. Ex. 5 | Comp. Ex. 6 | Comp. Ex. 7 |
| 500 | 0.64 | 0.58 | 0.55 | 1.25 | 0.47 |
| 400 | 0.47 | 0.39 | 0.39 | 0.83 | 0.28 |
| 350 | 0.36 | 0.31 | 0.30 | 0.59 | 0.20 |
| 300 | 0.28 | 0.24 | 0.25 | 0.39 | 0.14 |
| 250 | 0.15 | 0.11 | 0.12 | 0.16 | 0.08 |
| $D_{min}$ | 0.06 | 0.04 | 0.05 | 0.04 | 0.06 |

The foregoing specification and examples provide a complete description of the invention. Reasonable variations and modifications are possible from the foregoing disclosure without departing from either the spirit or scope of the present invention, which resides in the claims appended hereto.

We claim:

1. A thermographic element comprising a support having coated thereon a thermographic emulsion layer comprising:

(a) a light insensitive silver salt;

(b) a gallic acid reducing agent; and (c) an infrared radiation absorbing compound, wherein said element provides an image having a $D_{min}$ of less than about 0.2 and a $D_{max}$ of greater than about 3.0 in the ultraviolet spectral range when exposed to infrared radiation for a time and at an intensity sufficient to provide total energy of about 400 to 500 mJ/cm$^2$.

2. The element of claim 1 wherein the silver salt is the silver salt of a carboxylic acid containing 10 to 30 carbon atoms.

3. The element of claim 1 wherein the silver salt is silver behenate.

4. The element of claim 1 further comprising a polymeric binder.

5. The element of claim 4 wherein the binder comprises polyvinyl acetate, polyvinyl butyral, or a styrene/maleic anhydride copolymer.

6. The element of claim 1 that is substantially free of toner.

7. The element of claim 1 wherein the gallic acid is present in an amount of about 5 to 25 wt.% based on the total weight of the thermographic emulsion layer.

8. The element of claim 1 wherein the gallic acid is present in an amount of about 10 to 20 wt.% based on the total weight of the thermographic emulsion layer.

9. The element of claim 1 wherein the silver salt is present in an amount of about 5 to 60 wt.% based on the total weight of the thermographic emulsion layer.

10. The element of claim 1 wherein the silver salt is present in an amount of about 30 to 50 wt.% based on the total weight of the thermographic emulsion layer.

11. The element of claim 1 that provides an image having a $D_{min}$ of less than about 0.15 and a $D_{max}$ of greater than about 3.2 in the ultraviolet spectral range when exposed to infrared radiation for a time and at an intensity sufficient to provide total energy of about 400 to 500 mJ/cm$^2$.

12. The element of claim 1 wherein the infrared radiation has a wavelength of about 830 nm.

13. The element of claim 11 wherein the infrared radiation has a wavelength of about 830 nm.

14. The element of claim 1 wherein the infrared radiation absorbing compound has the following formula:

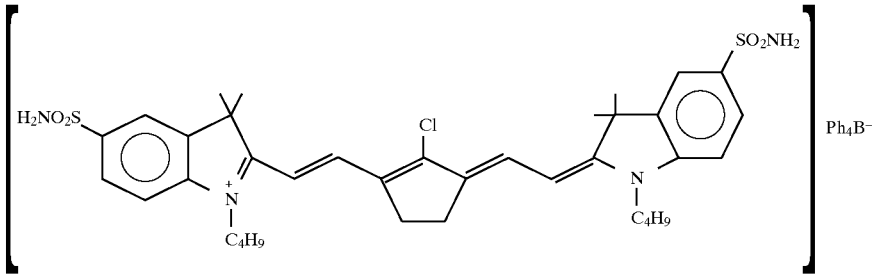

15. The element of claim 1 wherein said element further comprises a layer adjacent to said thermographic emulsion layer comprising additional infrared absorbing compound.

16. A method of forming an image by exposing a thermographic material to infrared radiation wherein the thermographic material comprises a support having a thermographic coating on at least one surface thereof, said coating comprising a light insensitive silver salt; a gallic acid reducing agent; and an infrared radiation absorbing compound.

* * * * *

UNITED STATES PATENT AND TRADEMARK OFFICE

CERTIFICATE OF CORRECTION

PATENT NO.: 5,840,469

DATED: November 24, 1998

INVENTOR(S): Bjork et al.

It is certified that errors appear in the above-identified patent and that said Letters Patent is hereby corrected as shown below:

First page, under U.S. PATENT DOCUMENTS should be added:

| | | |
|---|---|---|
| 5,629,130 | 05/1997 | Leender et al. |
| 4,882,265 | 11/1989 | Laganis et al. |
| 5,322,768 | 06/1994 | Delprato et al. |

Column 4, line 27, "thermnographic" should be --thermographic--.

Column 11, line 45 "we" should be --wet--.

Signed and Sealed this

Thirty-first Day of August, 1999

*Attest:*

Q. TODD DICKINSON

*Attesting Officer*

*Acting Commissioner of Patents and Trademarks*